US010772780B2

(12) United States Patent
Robertson

(10) Patent No.: US 10,772,780 B2
(45) Date of Patent: Sep. 15, 2020

(54) MOBILE MEDICAL OFFICE

(71) Applicant: Steve Robertson, Medina, OH (US)

(72) Inventor: Steve Robertson, Medina, OH (US)

( * ) Notice: Subject to any disclaimer, the term of this patent is extended or adjusted under 35 U.S.C. 154(b) by 28 days.

(21) Appl. No.: 16/249,698

(22) Filed: Jan. 16, 2019

(65) Prior Publication Data

US 2019/0216667 A1 Jul. 18, 2019

Related U.S. Application Data

(60) Provisional application No. 62/617,837, filed on Jan. 16, 2018.

(51) Int. Cl.

| | |
|---|---|
| ***A47B 85/04*** | (2006.01) |
| ***A61G 15/12*** | (2006.01) |
| ***A47C 7/00*** | (2006.01) |
| ***A47C 7/40*** | (2006.01) |
| ***A47C 7/70*** | (2006.01) |
| ***A47B 83/02*** | (2006.01) |
| ***A47B 21/00*** | (2006.01) |

(52) U.S. Cl.

CPC ..... *A61G 15/12* (2013.01); *A47B 21/00* (2013.01); *A47B 83/02* (2013.01); *A47B 85/04* (2013.01); *A47C 7/006* (2013.01); *A47C 7/407* (2013.01); *A47C 7/70* (2013.01)

(58) Field of Classification Search

CPC .. A47B 21/00; A47B 3/10; A47B 3/14; A47B 9/10; A47B 19/06; A47B 83/02; A47B 85/04; A47B 63/04; A47C 7/006; A47C 7/407; A47C 7/70; A47C 7/40; A47C 7/402; A61G 15/12

USPC ..... 297/125, 124, 118, 172, 135, 174 R, 297/157.1, 156; 280/47.26, 47.25; 312/223.3, 313, 249.81, 249.1; 190/12 A

See application file for complete search history.

(56) References Cited

U.S. PATENT DOCUMENTS

| | | | | |
|---|---|---|---|---|
| 2,781,201 | A | 2/1957 | Tremblay | |
| 4,097,606 | A | 6/1978 | Chavkin et al. | |
| 5,868,079 | A * | 2/1999 | Charny | A47B 21/00 108/7 |
| 6,571,720 | B2 * | 6/2003 | Moore | A47B 9/10 108/147 |
| 6,953,222 | B2 * | 10/2005 | Larrick | A47C 9/08 297/118 |
| 7,278,644 | B2 | 10/2007 | Villarreal | |
| 7,314,010 | B2 * | 1/2008 | George | A47B 9/20 108/50.01 |
| 7,614,639 | B2 | 10/2009 | Tholkes | |

(Continued)

OTHER PUBLICATIONS

U.S. Appl. No. 62/617,837, filed Jan. 16, 2018.

*Primary Examiner* — Chi Q Nguyen

(74) *Attorney, Agent, or Firm* — Renner, Otto, Boiselle & Sklar, LLP

(57) ABSTRACT

A mobile medical office may include a desk platform including a desk surface, and a telescoping swivel arm including a fixed portion and a telescoping portion, the fixed portion operably attached to a frame and the telescoping portion pivotably attached to the desk platform such that the desk platform is adjustable from a) a collapsed configuration in which the desk platform is in a position substantially perpendicular to a seating support to b) a deployed configuration in which the desk platform is in a position substantially parallel the seating support.

20 Claims, 10 Drawing Sheets

(56) References Cited

U.S. PATENT DOCUMENTS

| | | | | |
|---|---|---|---|---|
| 7,992,881 | B2 | 8/2011 | Edelblut | |
| 8,567,808 | B2 | 10/2013 | Tholkes | |
| 9,439,504 | B1 * | 9/2016 | Christlieb | G06F 1/1616 |
| 9,943,955 | B2 * | 4/2018 | Bozzano | B25H 1/04 |
| 2002/0145368 | A1 * | 10/2002 | Brown | A47B 63/04 312/313 |
| 2016/0244079 | A1 | 8/2016 | Grappe | |

* cited by examiner

MOBILE MEDICAL OFFICE

FIELD OF THE INVENTION

The present disclosure relates generally to in-home or off-medical facility medical care and particularly to a portable, light weight, rolling, folding chair/retractable desk combination device that may be used as a mobile medical office.

BACKGROUND

Significant injuries or chronic illnesses can make it difficult for patients to attend medical appointments outside the home. In addition, access to medical care facilities may be limited to patients in rural or remote areas. In-home or off-medical facility doctor or nurse's visits, once very common, are making a comeback to address these issues.

Unfortunately, a patient's home or other non-medical facility does not typically provide even the most basic tools the medical professional needs to properly visit with the patient.

SUMMARY OF THE INVENTION

The present disclosure provides a mobile medical office that provides tools needed by medical personnel when visiting with a patient at home or other off-medical facility settings.

The mobile medical office of the present disclosure may be easily and efficiently transported, not only within a facility, but also from one facility to another because it is relatively light in weight, particularly as compared to the prior art. Moreover, the mobile medical office is reconfigurable to make it easily deployable, storable, and transportable. Ease of transportation may allow for a single doctor or medical practitioner utilizing a single mobile medical office to provide consultation and/or care to multiple patients at multiple facilities potentially expanding availability of care and/or reducing costs.

These and further features of the present invention will be described with reference to the attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the terms of the appended claims.

The accompanying drawings, which are incorporated in and constitute a part of the specification, illustrate various example systems, methods, and so on, that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

DETAILED DESCRIPTION

Figure 1:
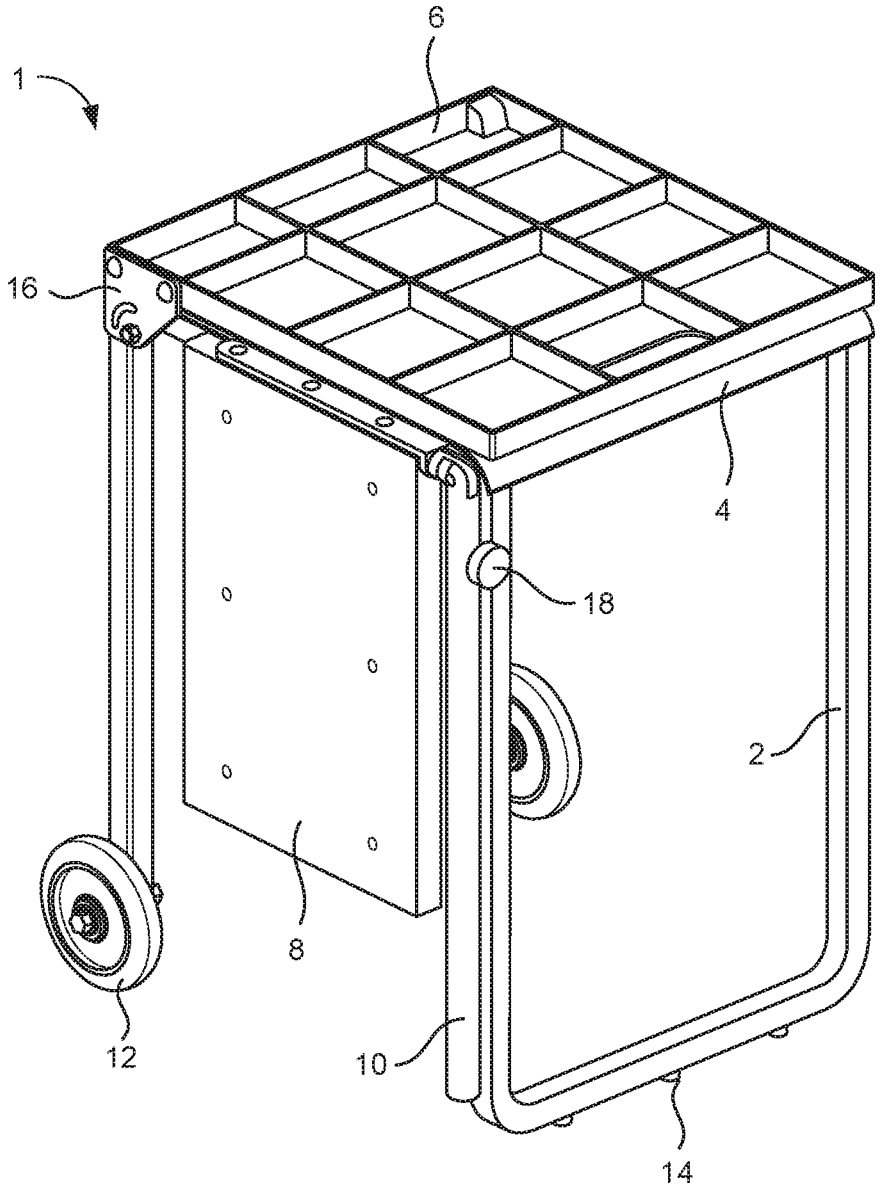
FIG. 1 illustrates a top front left perspective view of an exemplary device for a mobile medical office in a collapsed or folded configuration.

FIGS. 1-10 illustrate exemplary embodiments of the mobile medical office device 1. FIG. 1 illustrates the exemplary device 1 in a collapsed or folded state or configuration. FIGS. 7-10 illustrate the device 1 in a deployed state or configuration. FIGS. 2-6 illustrate the device 1 in configurations between the collapsed and deployed configurations.

The device 1 may include a frame 2, a seating support 4, a back support 6, a desk platform 8, a telescoping swivel arm 10, wheels 12, and feet 14.

The seating support 4 may be operably attached to a top portion of the frame 2. The back support 6 may be pivotably attached to the frame 2 at the top portion and particularly at or near a rear top portion of the frame 2. The device 1 may include brackets 16 that pivotably connect the back support 6 to the frame 2. In this manner, the back support 6 may be adjustable from a) the collapsed configuration of FIG. 1 in which the back support 6 is collapsed towards the seating support 4 in a position substantially parallel to the seating support 4 to b) the deployed configuration of FIGS. 7-10 in which the back support 6 is pivoted away from the seating support 4 in a position substantially perpendicular to the seating support 4.

The wheels 12 may be operably attached to a bottom portion and specifically a rear bottom portion of the frame 2.

The telescoping swivel arm 10 may include a fixed portion and a telescoping portion. The fixed portion may be operably attached to the frame 2 and the telescoping portion pivotably attached to the desk platform 8. In this manner, the desk platform 8 may be adjustable from the collapsed configuration of FIG. 1 to the deployed configuration of FIGS. 7-10. In the collapsed configuration of FIG. 1 most of the desk platform 8 is disposed between the bottom portion and the top portion of the frame 2 and between a front portion and a rear portion of the frame 2. In the collapsed configuration of FIG. 1, the desk platform 8 is in a position substantially perpendicular to the seating support 4. In the deployed configuration of FIGS. 7-10 the desk platform 8 is above the seating support 4 in a position substantially parallel to the seating support 4.

In FIG. 1, the exemplary device 1 has been folded or collapsed by folding the back support 6 towards the seating support 4, sliding in the telescoping swivel arm 10, and folding in the desk platform 8. In this configuration the volume occupied by the device 1 may be minimized for transportation. A user may tilt the device 1 to lift the feet 14 off the floor so that the device 1 rests only on the wheels 12. The user may then roll the device 1 on the wheels 12.

While the collapsed configuration of FIG. 1 is a compact configuration ideal for storage and transport, the deployed configuration of FIGS. 7-10 allows for a doctor or nurse to seat comfortably on the seating support 4 while using the desk surface of the desk platform 8 to write or to rest a laptop computer thereon making the device 1 very convenient for in-home or off-medical facility visits.

FIGS. 2-6 illustrate the device 1 in semi-deployed configurations between the collapsed and deployed configurations.

Figure 2:
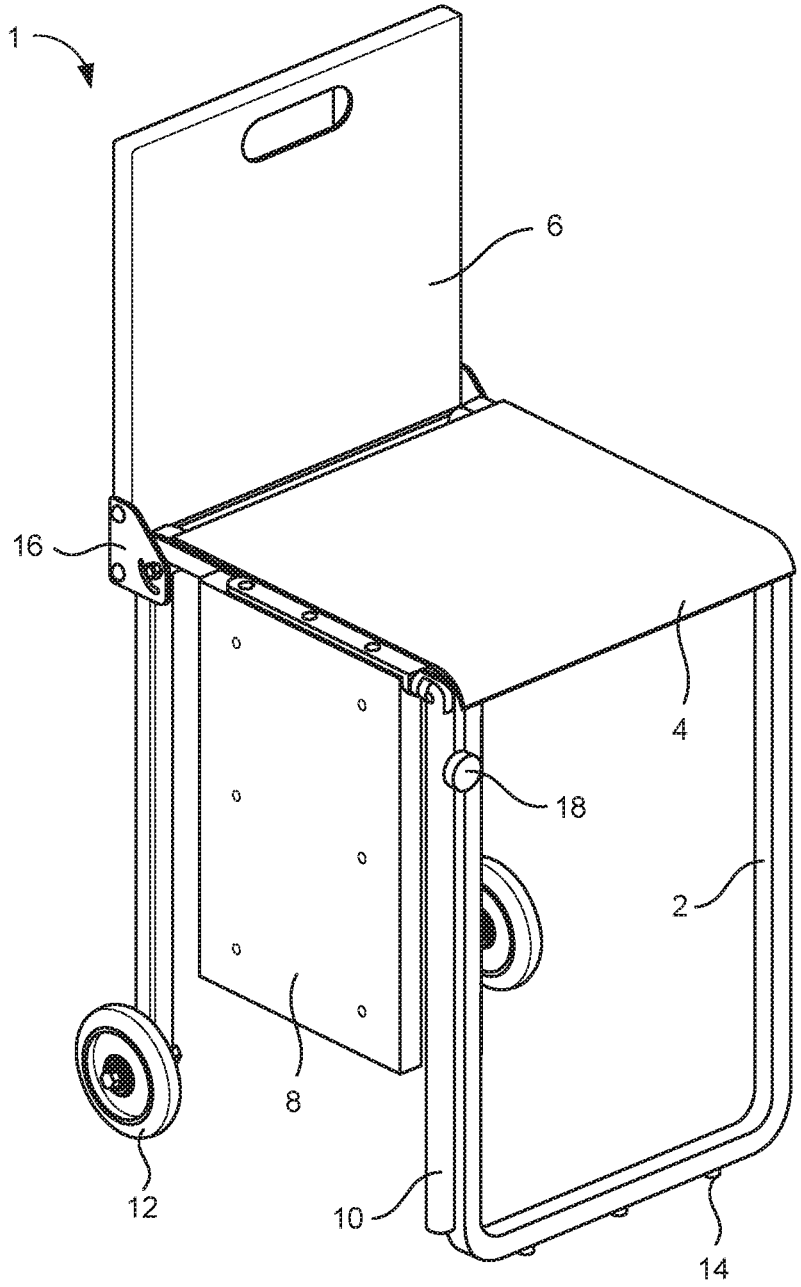
FIG. 2 illustrates a top front left perspective view of the exemplary device of FIG. 1 in a semi-deployed "plane chair" configuration.

FIG. 2 illustrates the device 1 in a "plain chair" configuration in which the back support 6 has been pivoted away from the seating support 4 to a position substantially perpendicular to the seating support 4 while most of the desk platform 8 remains disposed between the bottom portion and the top portion and between the front portion and the rear portion of the frame 2. This "plain chair" configuration may be useful when a simple seating device (with no writing or typing surface) is needed.

Figure 3:
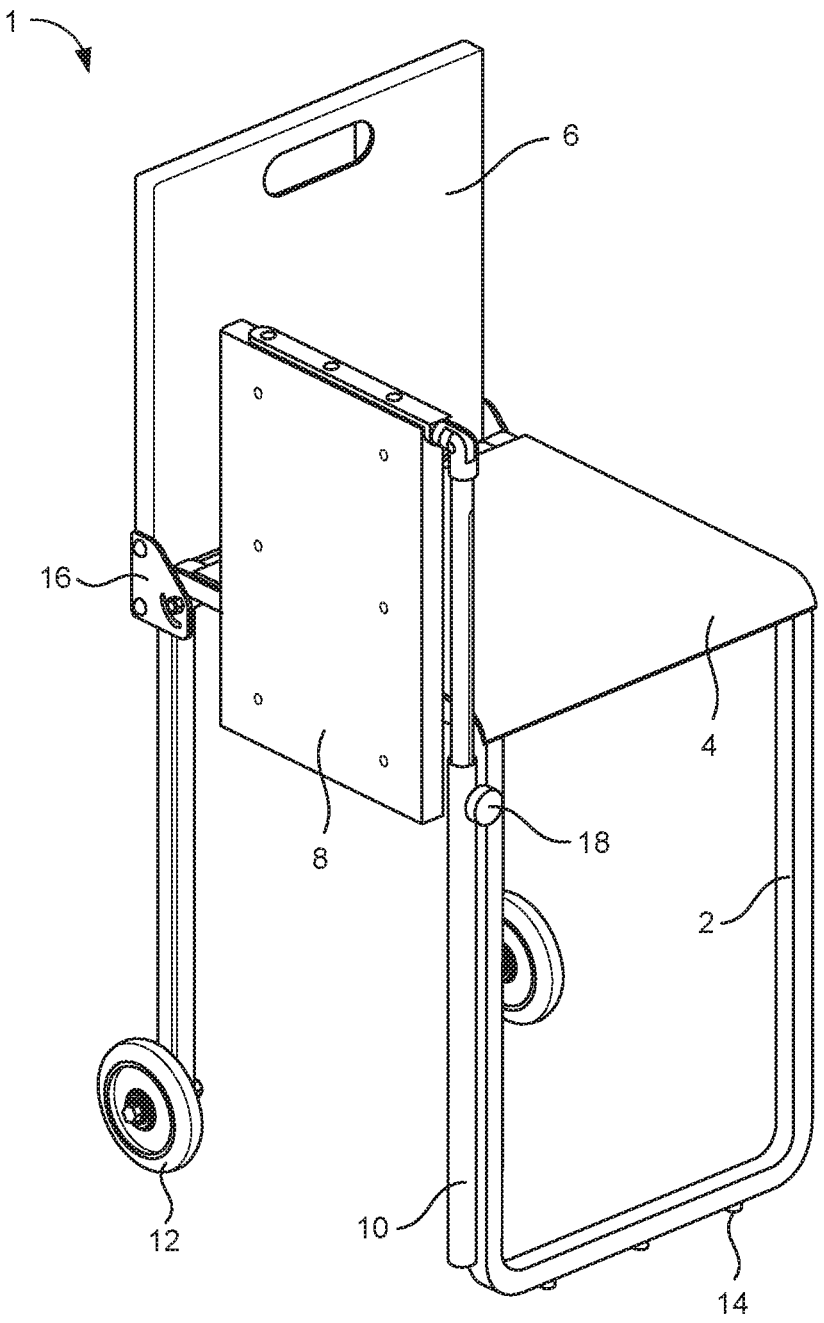
FIG. 3 illustrates a top front left perspective view of the exemplary device of FIG. 1 in a semi-deployed telescoped configuration.
Figure 4:
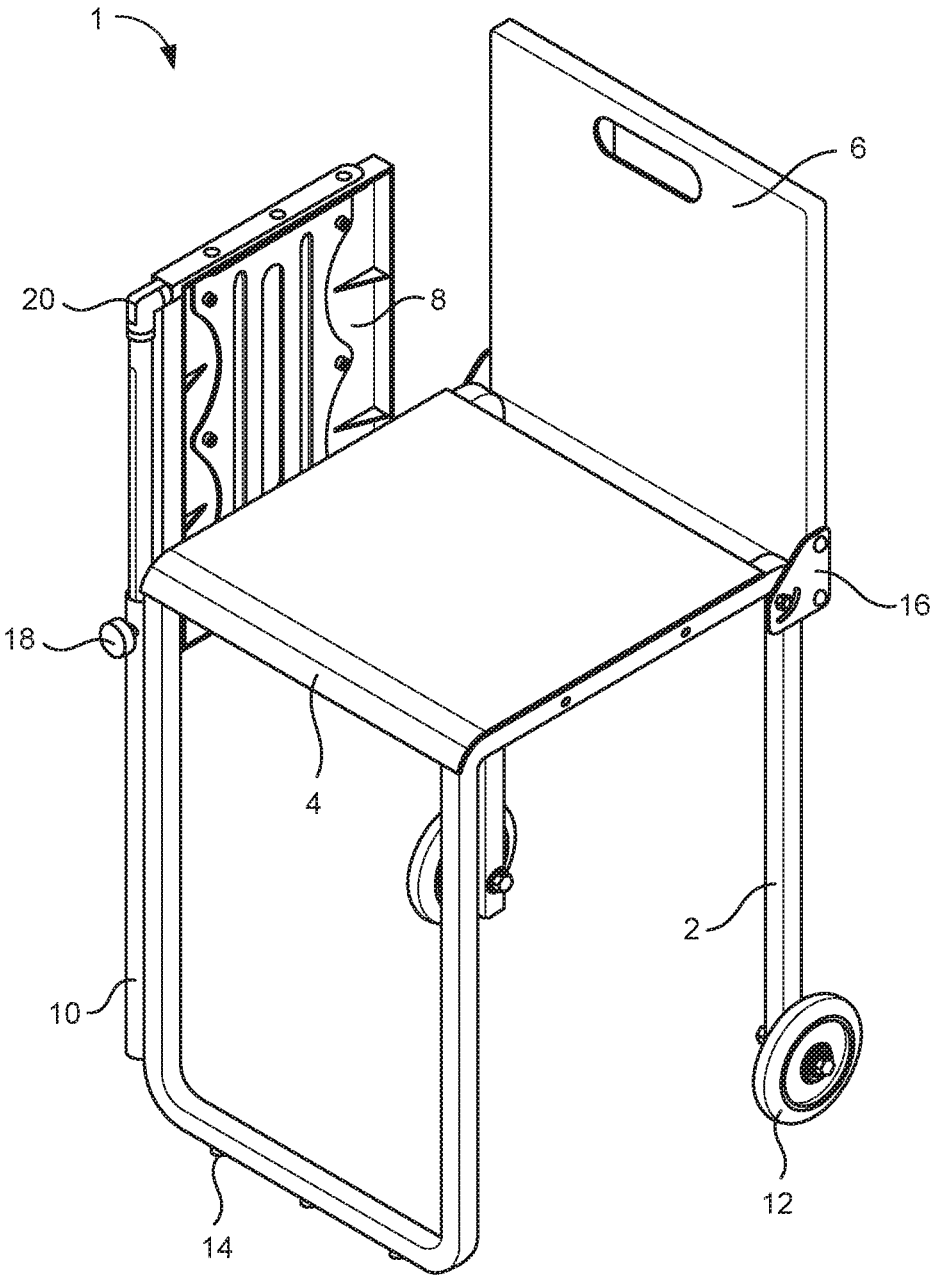
FIG. 4 illustrates a top front right perspective view of the exemplary device of FIG. 1 in the semi-deployed telescoped configuration.

FIGS. 3 and 4 illustrate the device 1 in a telescoped configuration in which most of the desk platform 8 has been moved above the top portion of the frame 2 but remains between the front and rear portions of the frame 2. This is accomplished by telescoping (i.e., sliding) out the telescoping portion of the telescoping swivel arm 10 from the fixed portion. Sliding out the telescoping arm 10 causes the desk platform 8 to rise relative to the seating support 4. The device 1 may include a lock 14 (e.g., a knob block) that may be locked to secure the telescoping portion to the fixed portion in this configuration (or the swiveled telescoped configuration of FIGS. 5-6 and the deployed configuration of FIGS. 7-10). In this telescoped configuration, the desk platform 8 remains substantially perpendicular to the seating support 4. To retum the device 1 to the collapsed or "plain chair" configurations of FIGS. 1 and 2, the lock 18 may be loosened to let the telescoping portion of the telescoping arm 10 slide back into the fixed portion.

Figure 5:
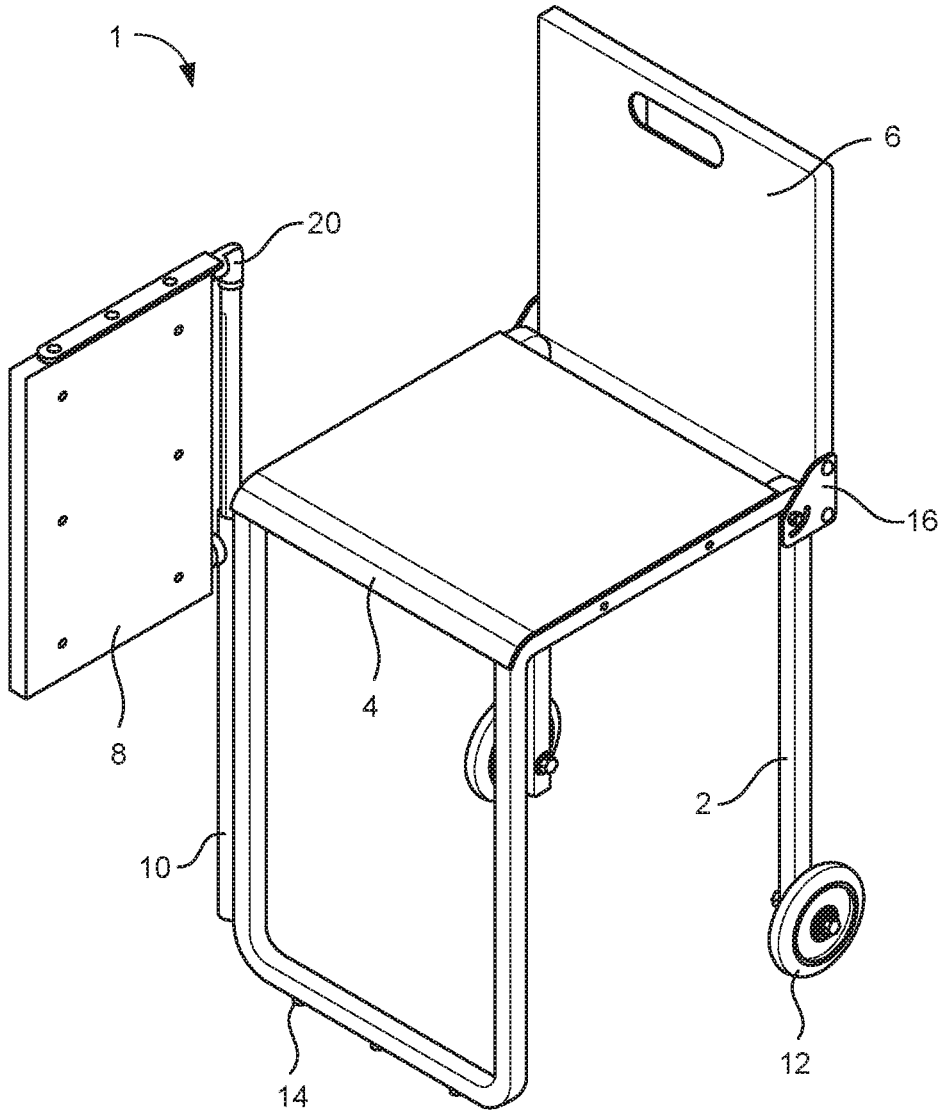
FIG. 5 illustrates a top front right perspective view of the exemplary device of FIG. 1 in a semi-deployed telescoped swiveled configuration.
Figure 6:
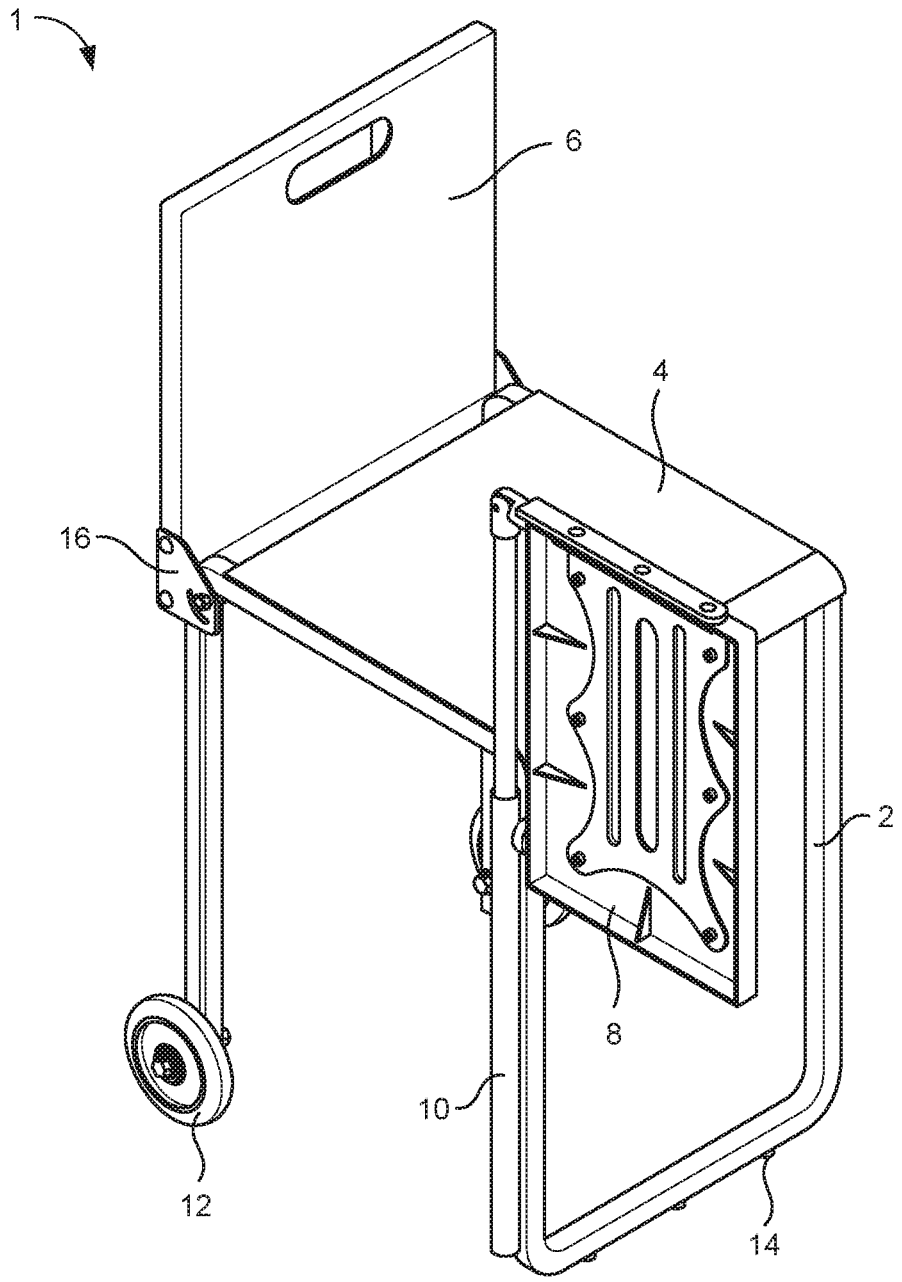
FIG. 6 illustrates a top front left perspective view of the exemplary device of FIG. 1 in the semi-deployed telescoped swiveled configuration.

FIGS. 5 and 6 illustrate the device 1 in a swiveled telescoped configuration in which most of the desk platform 8 remains above the top portion of the frame 2 but the desk platform 8 has now been swiveled around to be in front of the front portion of the frame 2. In this swiveled telescoped configuration, the desk platform 8 remains substantially perpendicular to the seating support 4.

From the swiveled telescoped configuration of FIGS. 5 and 6 the desk platform 8 may be swiveled up to the deployed configuration of FIGS. 7-10 in which the desk platform 8 is above the seating support 4 in a position substantially parallel to the seating support 4.

The present disclosure describes the frame 2 as having top, bottom, front, and rear portions. These terms are used for reference and the frame 2 may take various forms that include singular or plural amounts of each of these portions. For example, in the figures, the bottom portion of the frame 2 has three general portions: 1) two rear bottom portions to which the wheels 12 may be attached and 2) a front bottom portion to which the feet 14 may be attached. Similar results may be accomplished by a frame 2 having, for example, a single bottom portion to which the wheels 12 and the feet 14 may be attached. These same principles apply to all portions of the frame 2.

The back support 6 may have built thereon a handle that, in the configurations of FIGS. 2-10 in which the back portion 6 is substantially perpendicular to the seating support 4, may be used to roll the device on its wheels 12. For example, in the deployed configuration of FIGS. 7-10, a user may grab the handle, tilt the device 1 onto the wheels 12, and pull to roll the mobile medical device 1 on the wheels 12. Once at the desired location, the user may release the handle for the device 1 to rest on the wheels 12 and on the feet 14. The feet 14 may be made out of a material (e.g., rubber) that prevents the device 1 from rolling when the feet 14 are in contact with the floor.

Figure 7:
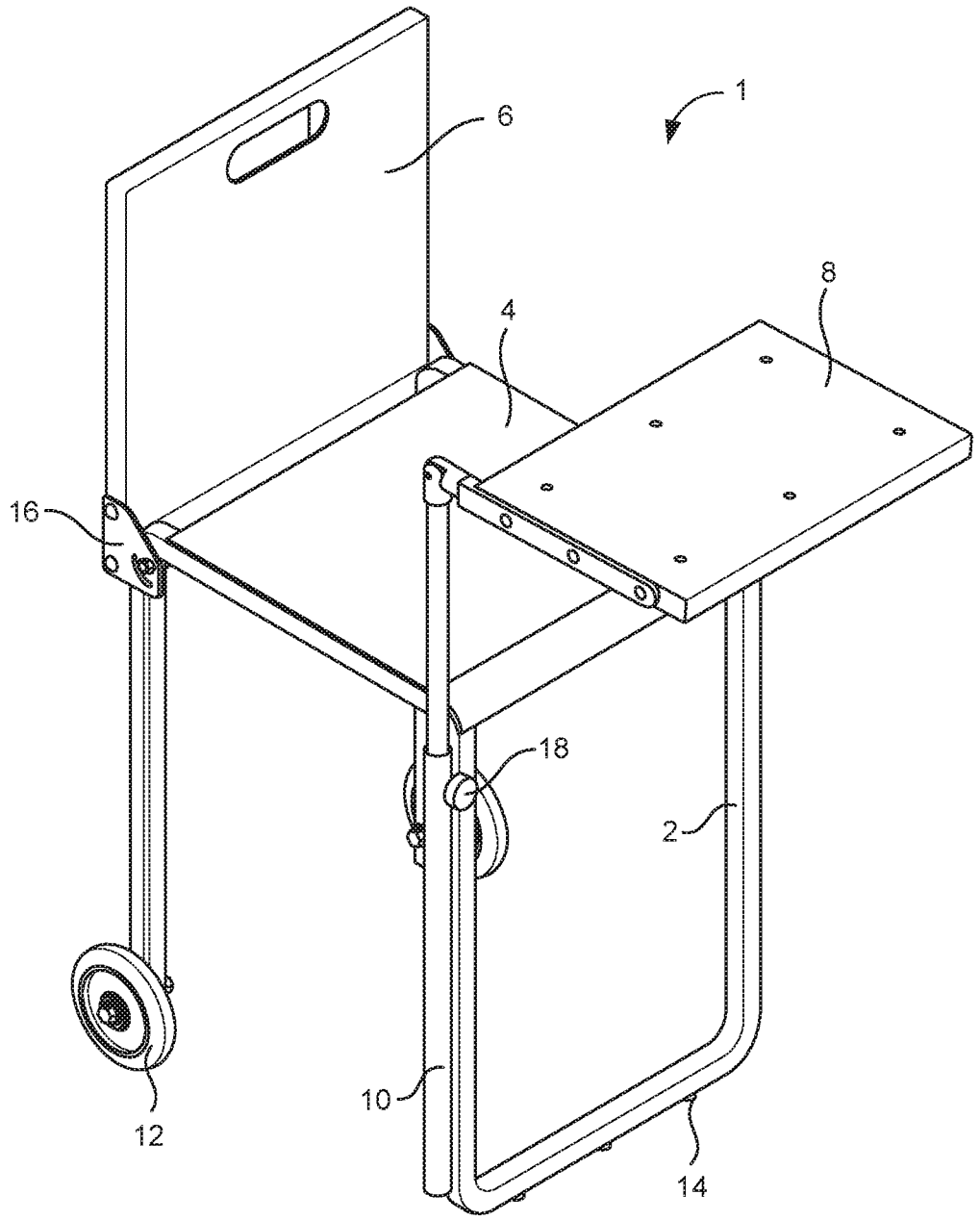
FIG. 7 illustrates a top front left perspective view of the exemplary device of FIG. 1 in a deployed state.
Figure 8:
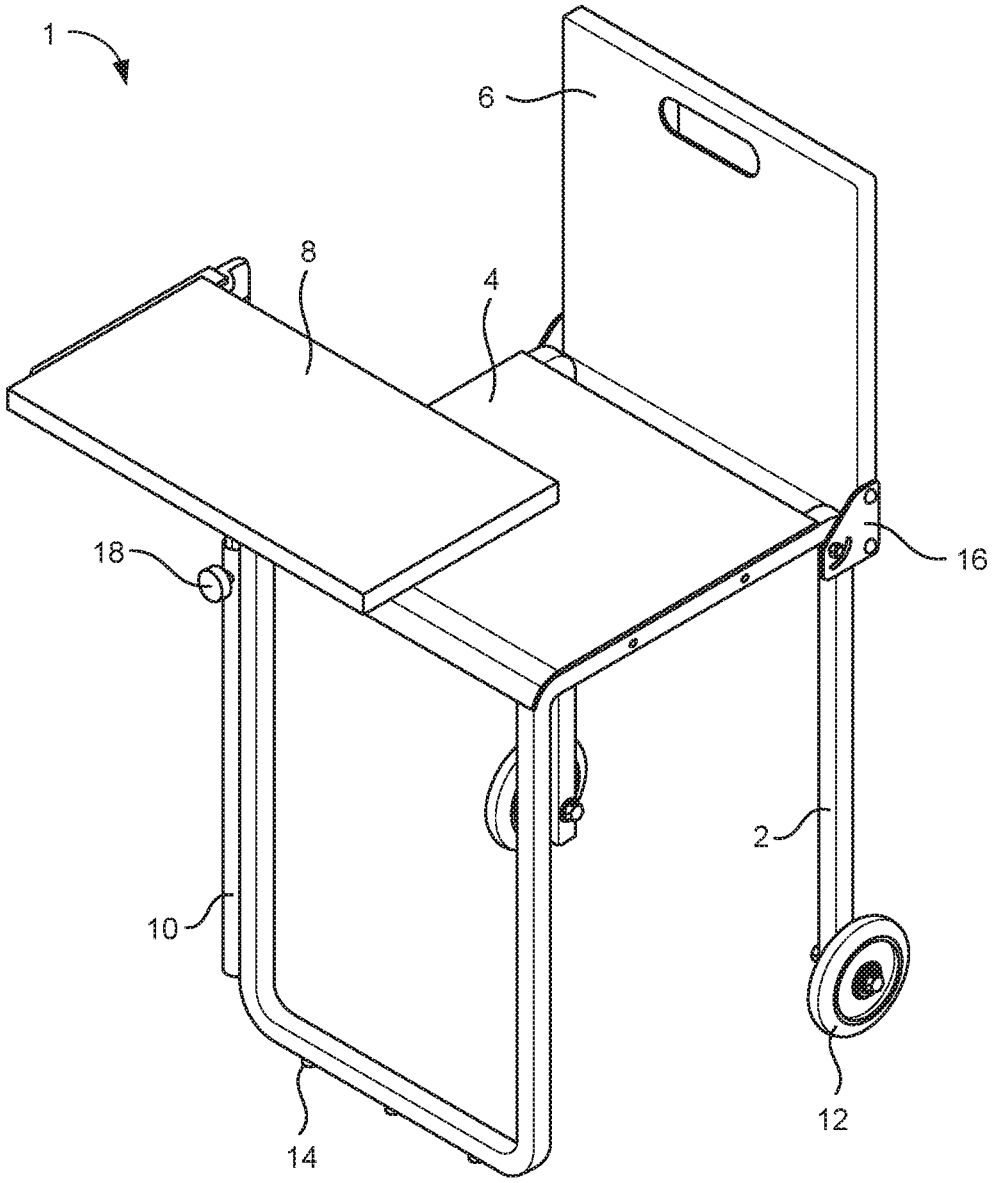
FIG. 8 illustrates a top front right perspective view of the exemplary device of FIG. 1 in the deployed state.
Figure 9:
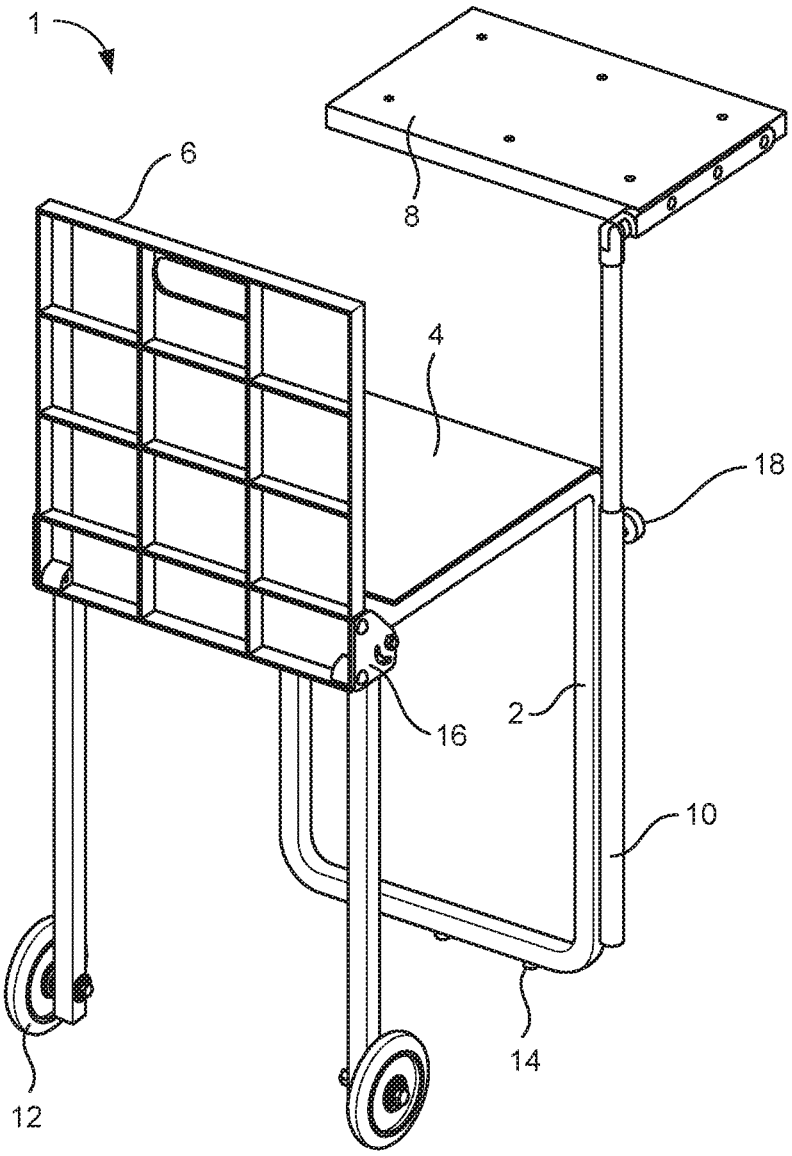
FIG. 9 illustrates a top rear left perspective view of the exemplary device of FIG. 1 in the deployed state.
Figure 10:
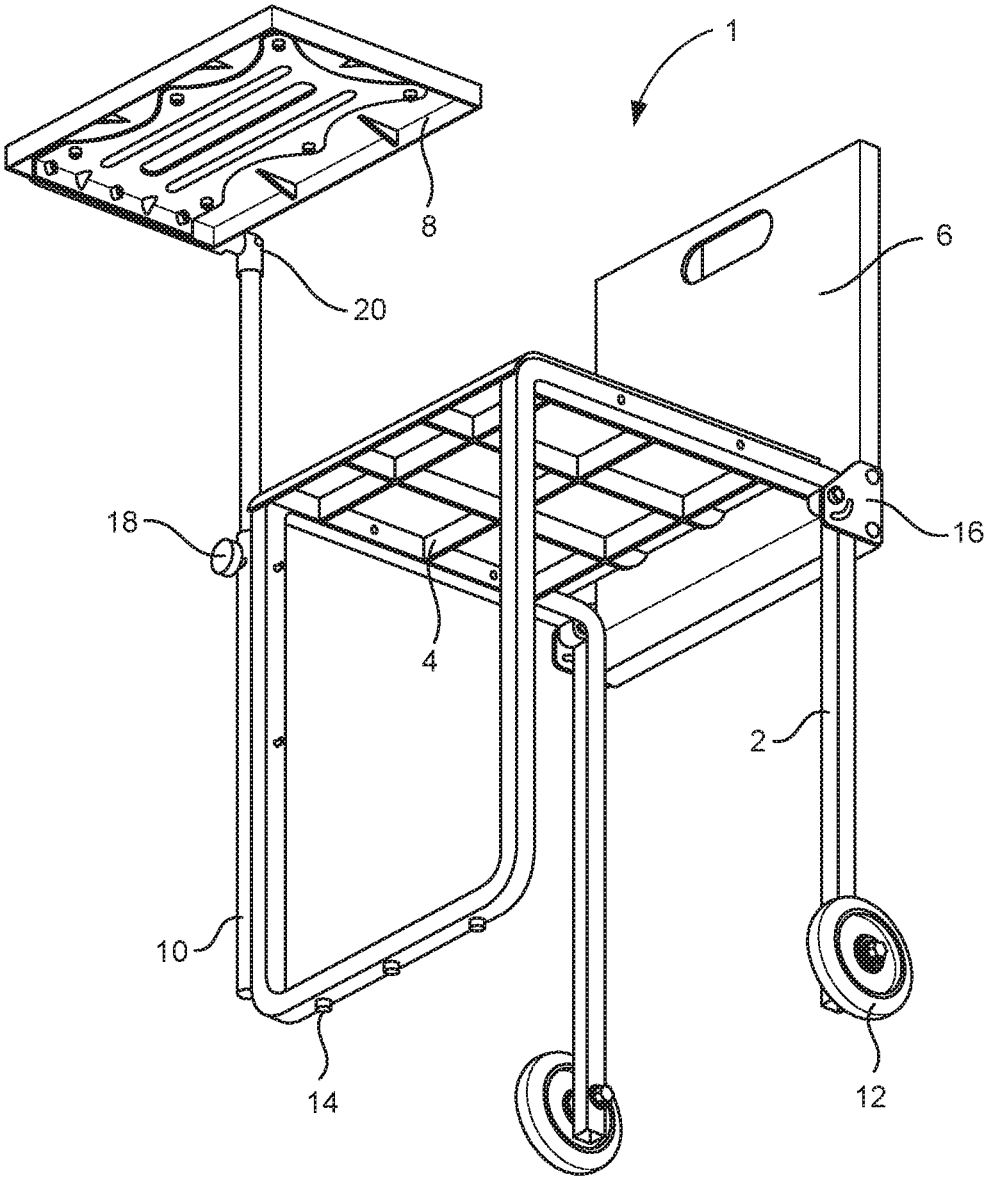
FIG. 10 illustrates a bottom front right perspective view of the exemplary device of FIG. 1 in the deployed state.

FIG. 7 illustrates the exemplary device 1 in a deployed state. The device 1 has been further unfolded by swiveling the desk platform 8 up. The telescoping arm 10 may include an elbow 20 with a resistance (e.g., friction) swiveling mechanism that, after the desk platform 8 has been swiveled up to the shown position, retains the desk surface in this position. In the deployed state, the feet 14 rest on the floor preventing the wheels 12 from rotating and, therefore, making the device 1 stable for sitting with comfortable and ergonomic seating support 4 and back support 6. The deployed desk platform 8 may be used as a writing surface or as support for a laptop or tablet computer.

In other embodiments the device 1 may include an attached storage/organizer unit, a supply organizer with optional HIPAA compliant storage, charging ports, Wi-Fi booster, company logo, etc. For example, in all configurations a significant volume remains inside the envelope formed by the frame 2. A bag or container may be attached to the frame 2 to occupy the volume inside the envelope formed by the frame 2. A user may then carry supplies in the bag or container.

The device 1 may be specifically designed for medical professionals and para-professionals who care for patients in the home or off-medical facility setting.

As used herein, an "operable connection" or "operable coupling," or a connection by which entities are "operably connected" or "operably coupled" is one in which the entities are connected in such a way that the entities may perform as intended. An operable connection may be a direct connection or an indirect connection in which an intermediate entity or entities cooperate or otherwise are part of the connection or are in between the operably connected entities.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995).

While example systems, methods, and so on, have been illustrated by describing examples, and while the examples have been described in considerable detail, it is not the intention of the applicants to restrict or in any way limit scope to such detail. It is, of course, not possible to describe every conceivable combination of components or methodologies for purposes of describing the systems, methods, and so on, described herein. Additional advantages and modifications will readily appear to those skilled in the art. Therefore, the invention is not limited to the specific details, the representative apparatus, and illustrative examples shown and described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

What is claimed is:

1. A mobile medical office, comprising:

a frame having at least one bottom portion, at least one top portion, at least one front portion and at least one rear portion;

wheels operably attached to the at least one bottom portion of the frame;

a seating support operably attached to the at least one top portion of the frame;

a back support pivotably attached to the frame at or near the at least one top portion such that the back support is adjustable from a) a collapsed configuration in the collapsed configuration the back support is collapsed towards the seating support in a position substantially parallel to the seating support, to b) a deployed configuration, in the deployed configuration the back support is deployed away from the seating support in a position substantially perpendicular to the seating support;

a desk platform including a desk surface; and a telescoping swivel arm including a fixed portion and a telescoping portion, the fixed portion operably attached to the frame and the telescoping portion pivotably attached to the desk platform such that the desk platform is adjustable from a) the collapsed configuration, in the collapsed configuration most of the desk platform is disposed between the at least one bottom portion and the at least one top portion and between the at least one front portion and the at least one rear portion in a position substantially perpendicular to the seating support, to b) a telescoped configuration, in the telescoped configuration most of the desk platform is above the at least one top portion between the at least one front portion and the at least one rear portion in a position substantially perpendicular to the seating support, to c) a swiveled telescoped configuration, in the swiveled telescoped configuration most of the desk platform is above the at least one top portion in front of the at least one front portion in a position substantially perpendicular to the seating support, to d) the deployed configuration, in the deployed configuration the desk platform is above the seating support in a position substantially parallel the seating support.

2. The mobile medical office of claim 1, comprising:

brackets that pivotably connect the seating support to the frame.

3. The mobile medical office of claim 1, wherein the telescoping swivel arm includes:

a lock configured to secure the telescoping portion to the fixed portion in the deployed configuration such that the desk platform is locked above the seating support in the position substantially parallel the seating support.

4. The mobile medical office of claim 1, wherein the at least one bottom portion includes at least one front bottom portion and at least one rear bottom portion, the wheels are operably connected to the at least one rear bottom portion.

5. The mobile medical office of claim 1, comprising:

at least one foot pad, wherein the at least one bottom portion includes at least one front bottom portion and at least one rear bottom portion, the wheels are operably connected to the at least one rear bottom portion, and the at least one foot pad is operably connected to the at least one front bottom portion.

6. The mobile medical office of claim 1, wherein the at least one bottom portion includes at least one front bottom portion and at least one rear bottom portion, and the at least one top portion includes at least one front top portion and at least one rear top portion, wherein the back support is operably attached to the at least one rear top portion, wherein the wheels are operably attached to the at least one rear bottom portion, and the back support has built thereon a handle operable to, in the deployed position, be pulled to roll the mobile medical device on the wheels.

7. The mobile medical office of claim 1, comprising:

at least one foot pad, wherein the at least one bottom portion includes at least one front bottom portion and at least one rear bottom portion, and the at least one top portion includes at least one front top portion and at least one rear top portion, the wheels are operably connected to the at least one rear bottom portion, the at least one foot pad is operably connected to the at least one front bottom portion, the back support is operably attached to the at least one rear top portion, the back support has built thereon a handle such that, in the deployed position, a user may grab the handle, tilt and pull the mobile medical device to roll the mobile medical device on the wheels, release the handle for the at least one foot to engage a floor surface to prevent the mobile medical device from rolling on the wheels.

8. A mobile medical office, comprising:

a frame having at least one bottom portion, at least one top portion, at least one front portion and at least one rear portion;

a seating support operably attached to the at least one top portion of the frame;

a back support pivotably attached to the frame at or near the at least one top portion such that the back support is adjustable from a) a collapsed configuration, in the collapsed configuration the back support is in a position substantially parallel to the seating support, to b) a deployed configuration, in the deployed configuration the back support is in a position substantially perpendicular to the seating support;

a desk platform including a desk surface; and a telescoping swivel arm including a fixed portion and a telescoping portion, the fixed portion operably attached to the frame and the telescoping portion pivotably attached to the desk platform such that the desk platform is adjustable from a) the collapsed configuration, in the collapsed configuration the desk platform is in a position substantially perpendicular to the seating support, to b) the deployed configuration, in the deployed configuration the desk platform is in a position substantially parallel the seating support.

9. The mobile medical office of claim 8, comprising:

brackets that pivotably connect the seating support to the frame.

10. The mobile medical office of claim 8, wherein the telescoping swivel arm includes:

a lock configured to secure the telescoping portion to the fixed portion in the deployed configuration such that the desk platform is locked in the position substantially parallel the seating support.

11. The mobile medical office of claim 8, wherein the at least one bottom portion includes at least one front bottom portion and at least one rear bottom portion, wheels are operably connected to the at least one rear bottom portion.

12. The mobile medical office of claim 8, comprising:

at least one foot pad, wherein the at least one bottom portion includes at least one front bottom portion and at least one rear bottom portion, wheels are operably connected to the at least one rear bottom portion, and the at least one foot pad is operably connected to the at least one front bottom portion.

13. The mobile medical office of claim 8, wherein the at least one bottom portion includes at least one front bottom portion and at least one rear bottom portion, and the at least one top portion includes at least one front top portion and at least one rear top portion, wherein the back support is operably attached to the at least one rear top portion, wherein wheels are operably attached to the at least one rear bottom portion, and the back support has built thereon a handle such that, in the deployed position, a user may grab the handle and pull to roll the mobile medical device on the wheels.

14. The mobile medical office of claim 8, comprising:

at least one foot pad, wherein the at least one bottom portion includes at least one front bottom portion and at least one rear bottom portion, and the at least one top portion includes at least one front top portion and at least one rear top portion, wheels are operably connected to the at least one rear bottom portion, the at least one foot pad is operably connected to the at least one front bottom portion, the back support is operably attached to the at least one rear top portion, the back support has built thereon a handle such that, in the deployed position, a user may grab the handle, tilt and pull the mobile medical device to roll the mobile medical device on the wheels, and release the handle for the at least one foot to engage a floor surface to prevent the mobile medical device from rolling on the wheels.

15. A mobile medical office, comprising:

a frame;

wheels operably attached to a bottom portion of the frame;

a seating support operably attached to a top portion of the frame;

a back support pivotably attached to the frame at or near the top portion such that the back support is adjustable from a) a collapsed configuration, in the collapsed configuration the back support is collapsed towards the seating support, to b) a deployed configuration, in the deployed configuration the back support is deployed away from the seating support;

a desk platform including a desk surface; and a telescoping swivel arm including a fixed portion and a telescoping portion, the fixed portion operably attached to the frame and the telescoping portion pivotably attached to the desk platform such that the desk platform is adjustable from a) the collapsed configuration, in the collapsed configuration most of the desk platform is disposed between the wheels and the seating support, to b) a telescoped configuration, in the telescoped configuration most of the desk platform is above the seating support, to c) a swiveled telescoped configuration, in the swiveled telescoped configuration most of the desk platform is above and in front of the seating support, to d) the deployed configuration, in the deployed configuration the desk platform is above the seating support and the desk surface is substantially horizontal.

16. The mobile medical office of claim 15, wherein the telescoping swivel arm includes:

a lock configured to secure the telescoping portion to the fixed portion in the deployed configuration such that the desk platform is locked above the seating support.

17. The mobile medical office of claim 15, wherein the wheels are operably connected to a rear bottom portion of the frame.

18. The mobile medical office of claim 15, comprising:

at least one foot pad, the wheels are operably connected to a rear bottom portion of the frame, and the at least one foot pad is operably connected to a front bottom portion of the frame.

19. The mobile medical office of claim 15, wherein the back support is operably attached to a rear top portion of the frame, wherein the wheels are operably attached to a rear bottom portion of the frame, and the back support has built thereon a handle such that, in the deployed position, a user may grab the handle and pull to roll the mobile medical device on the wheels.

20. The mobile medical office of claim 15, comprising:

at least one foot pad, the wheels are operably connected to a rear bottom portion of the frame, the at least one foot pad is operably connected to a front bottom portion of the frame, the back support is operably attached to a rear top portion of the frame, the back support has built thereon a handle such that, in the deployed position, a user may grab the handle, tilt and pull the mobile medical device to roll the mobile medical device on the wheels, and release the handle for the at least one foot to engage a floor surface to prevent the mobile medical device from rolling on the wheels.

* * * * *